US011035200B2

(12) United States Patent
Melenyzer

(10) Patent No.: US 11,035,200 B2
(45) Date of Patent: Jun. 15, 2021

(54) DOWNHOLE FORMATION PROTECTION VALVE

(71) Applicant: George James Melenyzer, Cypress, TX (US)

(72) Inventor: George James Melenyzer, Cypress, TX (US)

(73) Assignee: FRONTIER OIL TOOLS, Houston, TX (US)

( * ) Notice: Subject to any disclaimer, the term of this patent is extended or adjusted under 35 U.S.C. 154(b) by 468 days.

(21) Appl. No.: 15/924,970

(22) Filed: Mar. 19, 2018

(65) Prior Publication Data

US 2018/0266210 A1 Sep. 20, 2018

Related U.S. Application Data

(60) Provisional application No. 62/473,920, filed on Mar. 20, 2017.

(51) Int. Cl.

| | |
|---|---|
| ***E21B 34/08*** | (2006.01) |
| ***E21B 33/128*** | (2006.01) |
| ***E21B 23/06*** | (2006.01) |
| ***E21B 34/14*** | (2006.01) |
| ***E21B 43/12*** | (2006.01) |

(52) U.S. Cl.

CPC ..... *E21B 34/08* (2013.01); *E21B 23/06* (2013.01); *E21B 33/1285* (2013.01); *E21B 34/14* (2013.01); *E21B 43/128* (2013.01)

(58) Field of Classification Search

CPC ..... E21B 43/128

See application file for complete search history.

(56) References Cited

U.S. PATENT DOCUMENTS

| | | | | | |
|---|---|---|---|---|---|
| 6,138,765 | A * | 10/2000 | Russell | E21B 17/02 | 166/387 |
| 2005/0092501 | A1* | 5/2005 | Chavers | E21B 34/12 | 166/386 |
| 2006/0225893 | A1* | 10/2006 | Coon | E21B 43/128 | 166/386 |

* cited by examiner

*Primary Examiner* — Kristyn A Hall

(74) *Attorney, Agent, or Firm* — Nolte Lackenbach Siegel

(57) ABSTRACT

In a first aspect, a bidirectional formation protection valve includes: a tubular body having an inner diameter defining a fluid flow path therethrough and being adapted to be sealably disposed within a wellbore; an uphole valve disposed within the inner diameter of the tubular body to control fluid flow therethrough, the uphole valve being biased to close the fluid flow path against a first pressure and adapted to be opened upon receiving a stinger in the inner diameter, and a downhole valve disposed within the inner diameter of the tubular body to control fluid flow therethrough, the downhole valve being biased to close the fluid flow path against a second pressure and adapted to be opened upon receiving a stinger in the inner diameter. The first and second pressures are an uphole pressure from kill fluids and a downhole pressure from formation fluids.

7 Claims, 12 Drawing Sheets

DOWNHOLE FORMATION PROTECTION VALVE

CROSS-REFERENCE TO RELATED APPLICATIONS

This application claims priority to U.S. Provisional Patent Application having Ser. No. 62/473,920, which was filed Mar. 20, 2017. This priority application is hereby incorporated by reference in its entirety into the present application to the extent consistent with the present application.

STATEMENT REGARDING FEDERALLY SPONSORED RESEARCH OR DEVELOPMENT

Not applicable.

BACKGROUND

This section introduces information from the art that may be related to or provide context for some aspects of the technique described herein and/or claimed below. This information is background facilitating a better understanding of that which is disclosed herein. This is a discussion of "related" art. That such art is related in no way implies that it is also "prior" art. The related art may or may not be prior art. The discussion is to be read in this light, and not as admissions of prior art.

Hydrocarbons such as petroleum (i.e., "oil") and natural gas (i.e., "gas") are routinely extracted from wells in a producing geological formation (i.e., "formation"). New fields that have not been producing long may possess a sufficiently high formation pressure that the hydrocarbons can easily reach the earth's surface unassisted through the wellbore. However, many fields have been producing long enough (i.e., are "mature") such that formation pressures are insufficient for this to happen in enough quantity to make the well economical. The art has therefor developed a number of techniques for assisting the hydrocarbons to the surface.

One of these techniques is the use of an electronic submersible pump, or "ESP". The hydrocarbons will enter the wellbore and form what is called a "fluid column". The wellbore typically has also previously been fractured, or "fracked", to facilitate the hydrocarbons flow out of the formation. The ESP is attached to the end of a production string and run into the hole. It is positioned below the surface of the fluid column and above the fractures, if any, whereupon it pumps the hydrocarbons to the surface.

The ESP eventually has to be run out of the wellbore. The hydrocarbons frequently contain contaminants, such as sediment, that damage the ESP over time. Sometimes the ESP is old such that it has a short lifetime expectancy when run into the wellbore and it has to be replaces or repaired. Sometimes there are issues with the wellbore itself. And sometimes there is some other need for a workover of the well that means the ESP has to be run out. Whatever the reason, the ESP is run out at some point.

The hydrocarbons need to be retained within the wellbore while the ESP is run out of the wellbore. Some wells include pressure control equipment at the surface for this purpose. More, commonly, prior to running out the ESP, the operator pumps "kill fluid" into the wellbore. The kill fluid forms another column within the wellbore above the fluid column of hydrocarbons. The hydrostatic pressure exerted column of kill fluid is greater than the pressure exerted by the hydrocarbons. The kill fluid thus keeps the hydrocarbons from rising in the well without the need for surface pressure control equipment.

This kill process can sometimes nevertheless yield some negative consequences. For example, it is possible to damage the formation if the kill fluid exerts too much pressure. One particular negative consequence is that sometimes the kill fluid may overcome the hydrocarbons and enter the formation. This contaminates the reservoir and has other negative consequences.

The presently disclosed technique is directed to resolving, or at least reducing, one or all of the problems mentioned above. Even if solutions are available to the art to address these issues, the art is always receptive to improvements or alternative means, methods and configurations. Thus, there exists and need for technique such as that disclosed herein.

SUMMARY

In a first aspect, a bidirectional formation protection valve, comprises: a tubular body having an inner diameter defining a fluid flow path therethrough and being adapted to be sealably disposed within a wellbore; an uphole valve disposed within the inner diameter of the tubular body to control fluid flow therethrough, the uphole valve being biased to close the fluid flow path against a first pressure and adapted to be opened upon receiving a stinger in the inner diameter, and a downhole valve disposed within the inner diameter of the tubular body to control fluid flow therethrough, the downhole valve being biased to close the fluid flow path against a second pressure and adapted to be opened upon receiving a stinger in the inner diameter. The first and second pressures are an uphole pressure from kill fluids and a downhole pressure from formation fluids. In some embodiments, the first pressure is the uphole pressure and the second pressure is the downhole pressure. In other embodiments, the first pressure is the downhole pressure and the second pressure is the uphole pressure.

In a second aspect, a bidirectional formation protection valve comprises a tubular body having an inner diameter defining a fluid flow path therethrough and being adapted to be sealably disposed within a wellbore. An uphole valve is disposed within the inner diameter of the tubular body to control fluid flow therethrough. The uphole valve is biased to close the fluid flow path against uphole pressure and adapted to be opened upon receiving a stinger in the inner diameter. A downhole valve is also disposed within the inner diameter of the tubular body. The downhole valve controls fluid flow therethrough and is biased to close the fluid flow path against downhole pressure. It is furthermore adapted to be opened upon receiving a stinger in the inner diameter.

In a third aspect, a method for use in producing hydrocarbons from a well comprises: receiving a stinger disposed below an electronic submersible pump into a closed bidirectional formation protection valve emplaced in a wellbore in a manner isolating wellbore fluids from formation fluids. An uphole valve disposed within the inner diameter of the tubular body to control fluid flow therethrough is opened through engagement with the stinger as the stinger is received. A downhole valve disposed within the inner diameter of the tubular body downhole of the uphole valve to control fluid flow therethrough is also opened through engagement with the stinger as the stinger is received. The engagement of the stinger with the uphole end of the bidirectional formation protection valve is scaled. The opened downhole valve is closed as the stinger is retrieved and the opened uphole valve is closed as the stinger is retrieved.

In a fourth aspect, a method for use in producing hydrocarbons from a well, comprise emplacing a closed bidirectional formation protection valve in a wellbore in a manner isolating wellbore fluids from formation fluids outside the bidirectional formation protection valve. A stinger is disposed below an electronic submersible pump in a string. The string is run into the wellbore to position the pump in the wellbore and to stab the stinger into the bidirectional formation protection valve and open the bidirectional formation protection valve to fluid flow from the formation. The string is nm out of the wellbore to close the bidirectional formation protection valve to block fluid flow from the formation while isolating the formation fluid from the wellbore fluids.

The above paragraphs in this section present a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
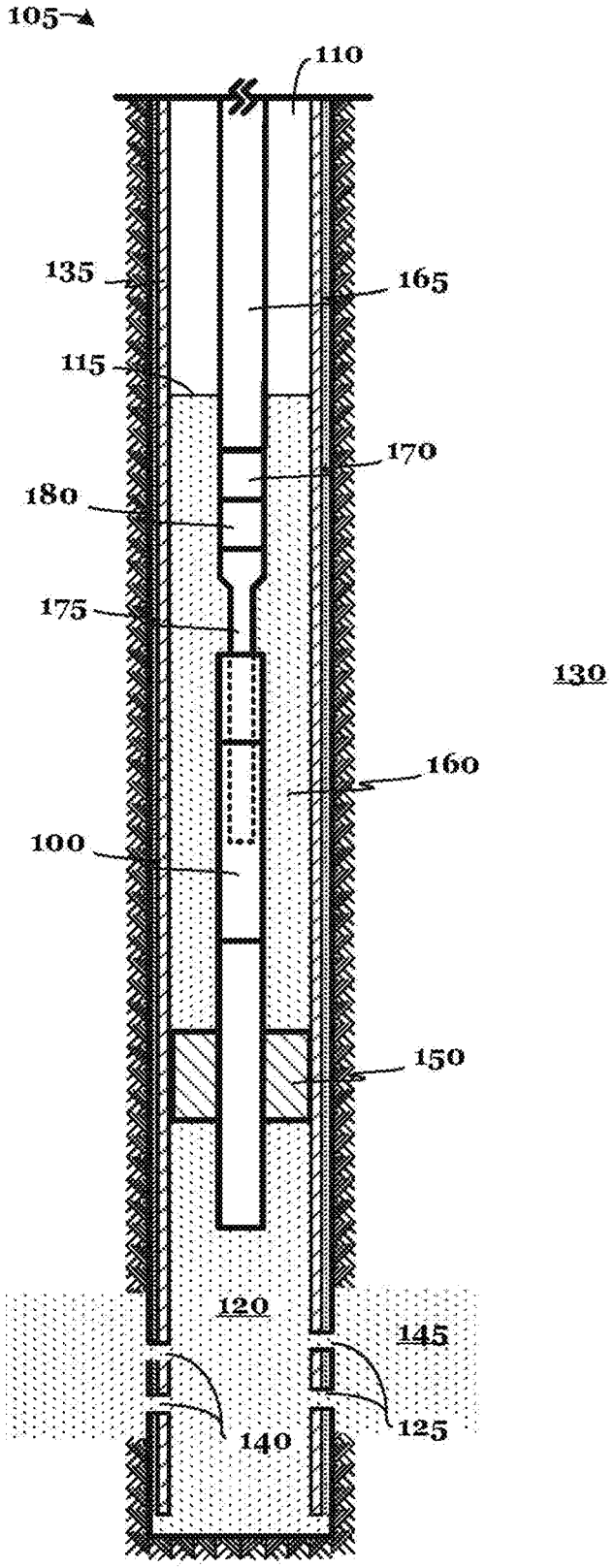
FIG. 1 depicts one particular embodiment of a downhole formation protection valve as deployed in an exemplary wellbore during production.

FIG. 1 depicts one particular embodiment of a downhole formation protection valve ("FPV") 100 as deployed in an exemplary well 105 during production. The well 105 is only partially shown. More particularly, the FPV 100 is disposed in a wellbore 110 below the fluid level 115 of the fluid column 120 and above the perforations 125 in the formation 130. The fluid column 120 comprises at least hydrocarbons such as oil and gas.

The perforations 125 are optional although it is anticipated that most wells 105 will have been fracked to create such perforations 125. Where present, they may be created by an earlier fracking operation that perforated not only the formation 130, but also the well casing 135. Again, it is anticipated that most wells 105 will be cased wells rather than open holes. Fracking is well known to the art and any suitable fracking technique known to the art may be used to create the perforations 140 in the casing 135 and perforations 125 in the formation 130. Similarly, the casing of wells 125 is well known in the art and any suitable casing technique may be used to place the casing 135 in the well 105.

The perforations 125, 140 are created at a depth in the wellbore 110 coincident with the reservoir 145 in the formation 130 as is well known in the art. The perforations 125, 140 facilitate the movement of hydrocarbons from the reservoir 145 into the wellbore 110 to form the fluid column 120. Thus, the depth at which the perforations are 125, 140 are created will be implementation specific. Some embodiments may include more than one set of perforations 125, 140 at the same or different depths. The fluid level 115 is a function of a number of parameters well known to the art that are unique to the wellbore 110, the formation 130, the reservoir 145, and the hydrocarbons. The depth at which the fluid level 115 resides will therefor also be implementation specific.

The FPV 100 is fluidly sealed within the wellbore 110 a sealing mechanism 150. The sealing mechanism 150 in the illustrated embodiment is a hydraulic packer as is well known in the art. However, other types of packers, and even other types of scaling mechanisms may be used in alternative embodiments. Thus, the sealing mechanism 150) is, by way of example and illustrate, but one means for sealing the annulus 160 between FPV 100 and the casing 135 to fluid flow.

Note that the fluid level 115 is above the FPV 100 in FIG. 1. That is because the fluid column 120 exists within the wellbore 110 prior to the installation of the FPV 100. Thus, when the sealing mechanism 150 is actuated to seal fluid flow through the annulus 160, there is still fluid above the sealing mechanism 150 and, hence, the FPV 100. The FPV 100 is therefore emplaced below the fluid level 115 but above the perforations 125, 140 in FIG. 1.

FIG. 1 also includes a production string 165 already run into the wellbore 110. For the most part, the composition and constitution of the production string 165 will be driven by the individual needs of the operator in light of the individual characteristics of the well 105 in a manner well known to the art. However, of pertinence to the presently disclosed technique, and in a sharp departure from the known art, the production string 165 terminates in an ESP 170 beneath which a stinger 175 is disposed. The ESP 170 is positioned below the fluid level 115 in the illustrate embodiment and, again, above the perforations 125, 140. Thus, the ESP 170 is submerged in the fluid column 120 in conventional fashion. The production string 165 also includes a check valve 180.

As will be further described below, the stinger 175 engages the FPV 100 as it is run into the wellbore 110. This engagement results in the stinger 175 opening the FPV 100 to establish a fluid flow path between that portion of the wellbore 110 below the sealing mechanism 150 and the surface (not shown). More particularly, the ESP 170 pumps the hydrocarbons below the sealing mechanism 150 through the stinger 175 and up through the production string 165 to the surface. During this operation, because the annulus 160 is scaled by the sealing mechanism 150, no hydrocarbons rise through the wellbore 110 other than through the stinger 175 and drill string 165.

Also as will be described further below, when the production string 165, including the ESP 170 and stinger 175, is run out of the wellbore 170, the stinger 175 disengages from the FPV 100 on its way out. This disengagement closes the FPV 100. At this point, fluid flow through the annulus 160 is sealed by the sealing mechanism 150 fluid flow through the FPV 100 is closed by the FPV 100 itself.

Thus, hydrocarbons in the reservoir 145—i.e., formation fluids—are prevented from flowing up the wellbore 110 past the FPV 100. At the same time, kill fluids (not shown) previously pumped into the wellbore 110 to kill the well 105 cannot flow downward past the FPV 100 into the formation 130. This is also prevented by the seal from the sealing mechanism 150 and the FPV 100. Thus, the kill fluids and the formation fluids are isolated from one another when the ESP is run out of the wellbore 110.

Thus, in one aspect of the technique disclosed herein, method for use in producing hydrocarbons from a well comprises emplacing a closed bidirectional FPV 100 in a wellbore in a manner isolating wellbore fluids, such as kill fluids, from formation fluids outside bidirectional FPV 100. A stinger 175 is disposed below an ESP 170 in a string 165. The string 165 is run into the wellbore 110 to position the ESP 170 in the wellbore 110 and to stab the stinger 175 into the bidirectional FPV 100 and open the bidirectional FPV 100 to fluid flow from the formation 130. Eventually, the string 165 is run out of the wellbore 110 to close the bidirectional FPV 100 to block fluid flow from the formation 130 while isolating the formation fluid from the wellbore fluids.

Figure 2:
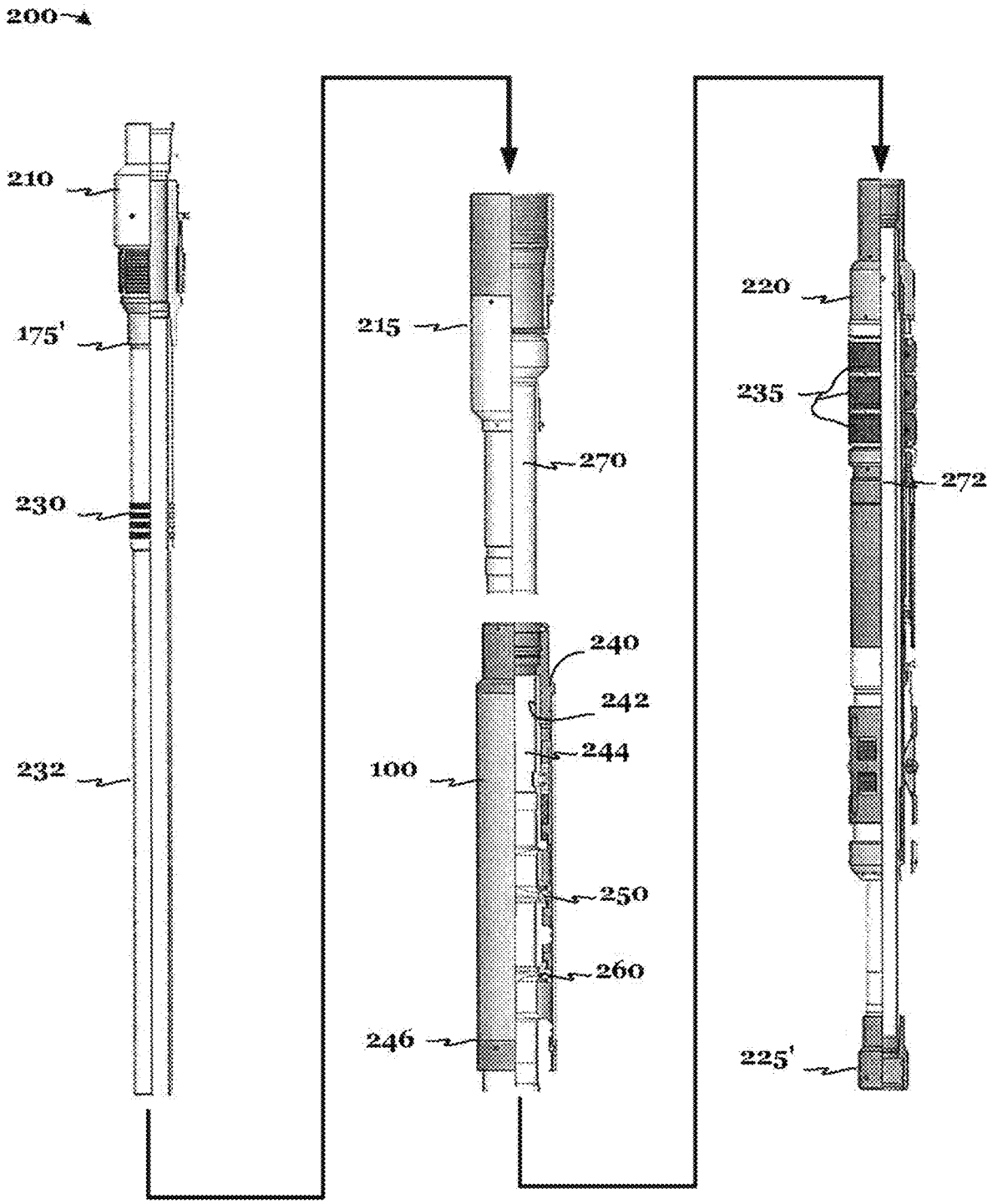
FIG. 2 is a hook up drawing depicting in partially sectioned, plan views selected portions of a running string including the formation protection valve for emplacing the formation protection valve in the formation.

Turning now to FIG. 2, selected portions of a running string 200 (not otherwise shown) for emplacing the FPV 100 in the formation 130, both first seen in FIG. 1, is shown. The running string 200 comprises a sub 210 by which a running stinger 175' is disposed. The running string 200 further comprises a running sub 215, the FPV 100, and a packer 220 terminated by a pump out sub 225.

The running sub 215 is, in the illustrated embodiment, an on/off tool. However, many suitable alternative embodiments are known to the art. For example, in one alternative embodiment not shown the running sub 215 comprises an anchor latch sub and a polished bore receptacle ("PBR"). The anchor latch sub includes a production type collet mechanism and a debris barrier. The debris barrier prevents debris from settling into and possibly fowling the FPV 100 when the well is shut in. The PBR provides a sealing bore for the stinger seals 230 on the tongue 232 of the stinger 175 to prevent annular debris. It also accommodates later tubing movement of the production string during heat up and operation. In general, though, the running sub 215 may be any suitable tool known to the art with a running profile.

The packer 220 of the illustrated embodiment is a conventional, hydraulically set packer. As is usual for such packers, it includes a plurality of rubber sealing elements 235 that can be expanded by the pump out sub 225 when in place to seal the annulus 160 around the packer 220 from fluid flow. However, any suitable packer or sealing tool known to the art may be used. Some embodiments may not even choose to utilize and separate packing tool and instead incorporate this annulus sealing capability into the FPV 100.

The FPV 100 is a bidirectional formation protection valve. It comprises a tubular body 240 having an inner diameter 242 defining a fluid flow path 244 therethrough and being adapted to be sealably disposed within a wellbore—e.g., the wellbore 110. In the illustrated embodiment, the FPV 100 is adapted to be sealably disposed in two ways that work in conjunction as described below. First, the tubular body 240 is so adapted by threading the downhole end 246 of the inner diameter 242 to receive the packer 220 and, in operation, actually engaging the packer assembly 220. Second, the tubular body 240 is also so adapted by being designed to sealably seat and threadably engage the production stinger 175.

The FPV 100 further comprises an uphole valve 250 disposed within the inner diameter 242 of the tubular body 240 to control fluid flow therethrough. The uphole valve 250 is biased to close the fluid flow path 244 against a first pressure and adapted to be opened upon receiving the stinger 175 in the inner diameter 242. The FPV 100 also includes a downhole valve 260 disposed within the inner diameter 242 of the tubular body 240 to control fluid flow therethrough. The downhole valve 260 is biased to close the fluid flow path 244 against a second pressure and adapted to be opened upon receiving the stinger 175 in the inner diameter 240.

The first and second pressures are an uphole pressure from kill fluids (not yet shown) and a downhole pressure from formation fluids in the fluid column 120, shown in FIG. 1. In the illustrated embodiment, the first pressure is the uphole pressure and the second pressure is the downhole pressure. However, alternative embodiments may differ. For example, in some embodiments, the first pressure may be the downhole pressure while the second pressure may be the uphole pressure.

Still referring to FIG. 2, the running sub 215 and packer 220 also define respective fluid flow paths 270, 272 that align with the fluid flow path 244 of the FPV 100 when assembled as described above. The running sub 215 and packer 220 are also emplaced with the FPV 100 as alluded to above and will be discussed above. Thus, the running sub 215 and packer 220 can be considered a part of the tubular body 240 when assembled and, hence, a part of the FPV 100 for purposes of emplacement and production.

Figure 3A:
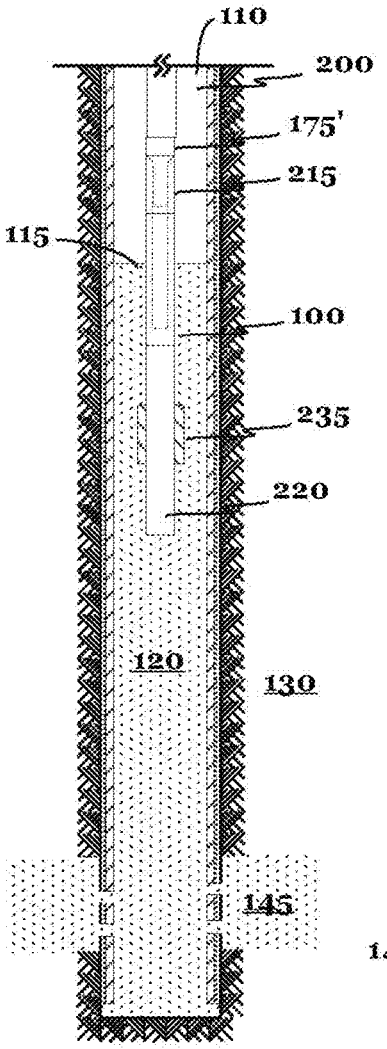
FIG. 3A-FIG. 3C conceptually illustrate the emplacement of the formation protection valve.
Figure 3B:
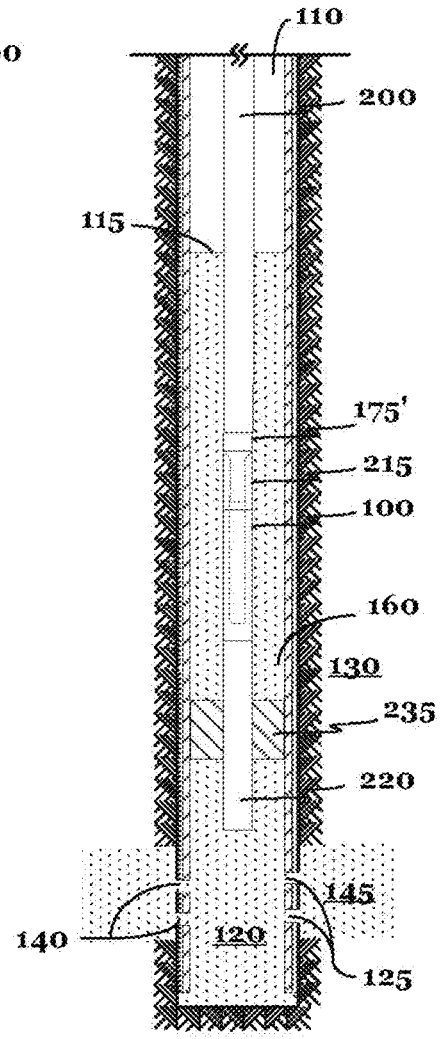
Figure 3C:
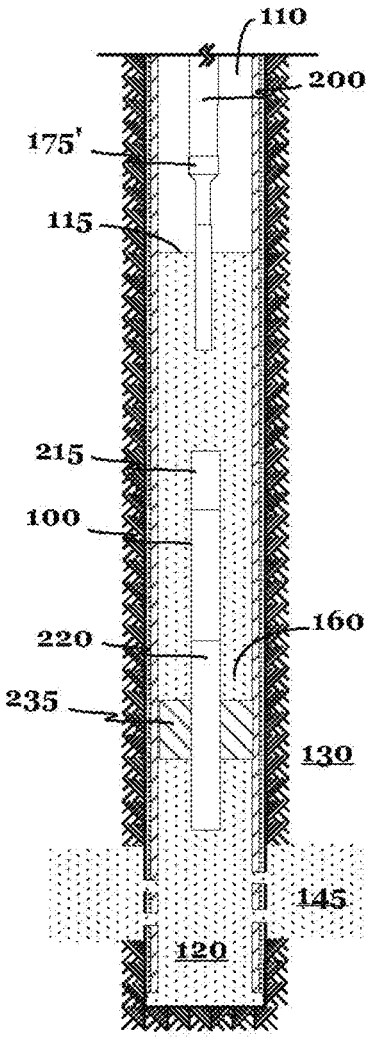

FIG. 3A-FIG. 3C conceptually illustrate the emplacement of the FPV 100. The running string 200 is assembled at the surface. This includes the subassembly 200 and the assembly 205. Each of the running stringer 210, the running sub 215, the FPV 100, and the packer 220—all shown in FIG. 2—are threaded together. These threaded connections form fluid tight seals. This assembly will depend to some degree on implementation of the various components. These variations will be readily appreciated by those ordinarily skilled in the art having the benefit of this disclosure.

Once assembled, the running string 200 is run into the wellbore 110 as shown in FIG. 3A until it is positioned as desired. Once positioned, the packer 220 is set and the rubber sealing elemental 235 extended to seal the annulus 160 as shown in FIG. 3B. What constitutes a desirable position will be implementation specific depending on a number of factors such as the height of the fluid column 120, the placement of the perforations 125, 140, the intended composition of the production string, and the composition and length of the assembly 200 being emplaced. One driving consideration is that the ESP 170 should be below the fluid level 115. The FPV 100 should also be located above the perforations 125, 140.

Once the FPV 100 is emplaced, the running stinger 175' is disengaged from the running sub 215 and run out of the wellbore 110 as shown in FIG. 3C. The way in which the disengagement is performed will depend on the implementation of the running sub 215 in a manner known to the art.

Figure 4:
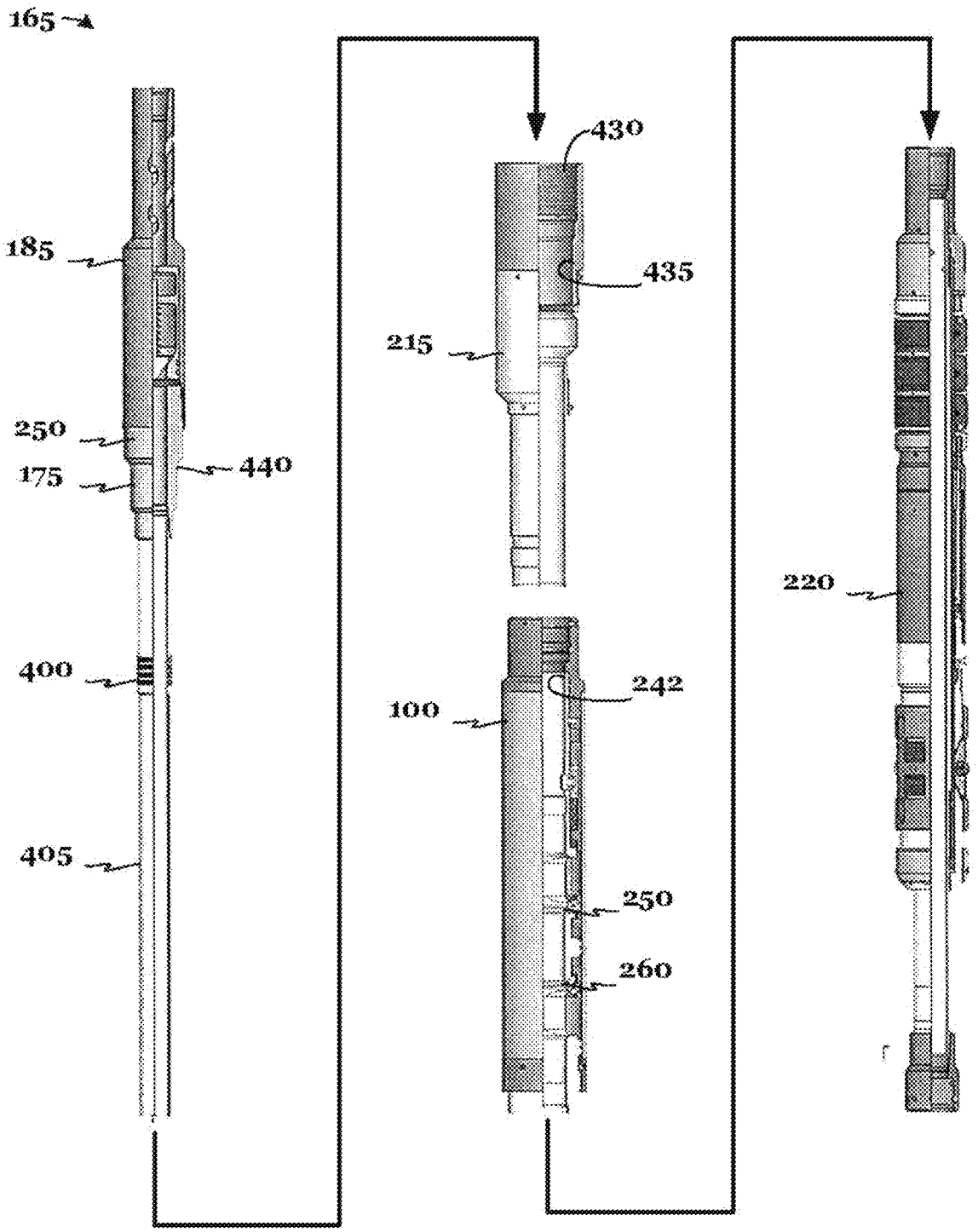
FIG. 4 is a hook up drawing depicting in partially sectioned views of elected portions of the production string of FIG. 1 in conjunction with the formation protection valve as part of an assembly for producing hydrocarbons.

FIG. 4 depicts selected portions of the production string 165, first seen in FIG. 1, in partially sectioned views in conjunction with the FPV 100. Note that, when the production string 165 is run into the wellbore 110 the running sub 215. FPV 100, and packer 220 are already emplaced as shown in FIG. 3C. Furthermore, the packer 220 is already set, also as shown in FIG. 3C.

The production stinger 175 includes, in this particular embodiment, the check valve 185. The check valve 185 is run below and attached to the ESP 170, which is not shown in FIG. 4. When the ESP 170 stops during production, the check valve 185 will close. This prevents any fluid and/or debris in the wellbore 110 for settling back into the formation 130 when the production stinger 175 is in place and the FPV 100 is open. The check valve 185 is a one-way flow device. When the ESP 170 is operating, the check valve 185 and the FPV 100 are open and flowing. When the ESP 170 is shut down, the FPV 100 remains open but the check valve 185 closes.

The production stinger 175 has several functions during production. The production stinger 175 has a plurality of seals 400 on the tongue 405 thereof. These seals 400 prevent fluid and/or debris in the wellbore 110 for settling back into the formation though the annulus between the tongue 405 and the inner diameter 242 of the FPV 100. In the illustrated embodiment, the seals are elastomeric O-rings such as are known to the art. However, alternative embodiments may use alternative sealing mechanisms. Thus, the elastomeric O-rings are, by way of example and illustration, but one means for sealing the annulus.

Figure 5A:
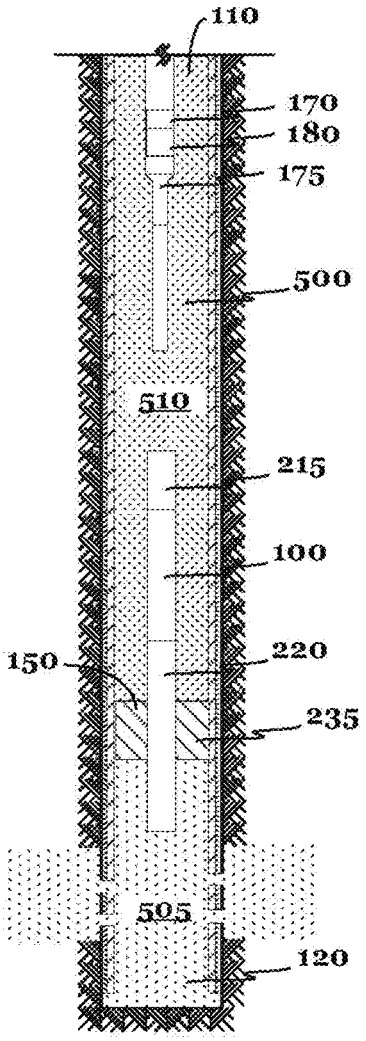
FIG. 5A-FIG. 5C conceptually illustrate running in and out the production string while the formation protection valve is emplaced.
Figure 5B:
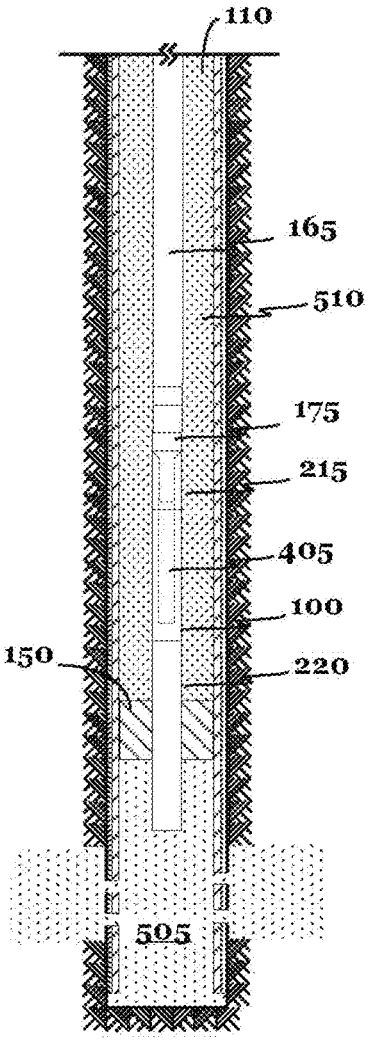

The seals 400 are located on the tongue 405 so that when the production stinger 175 is seated on the running sub 215 as shown in FIG. 5B they are located within the inner diameter 242 of the FPV 100 but above the uphole valve 250. This positioning helps protect the seals 400 from wear that would otherwise be incurred traveling through one or more of the uphole valve 250 and the downhole valve 260 as the production stinger 175 is stroked into the FPV 100. Thus, it increases the life expectancy of the seals 400 and extends the periods between retrievals for their replacement.

However, such positioning is not required. Some embodiments may position the seals 400 on the tongue 405 so that they are stroked past both the uphole valve 250 and the downhole valve 260 while remaining within the inner diameter 242 of the FPV 100. This would have the salutary effect of preventing debris from entering the FPV 100 from below. However, this is offset by the reduced lifetime expectancy of the seals 400 due to the increased wear traveling through the uphole valve 250 and the downhole valve 260.

The production stinger 175 also wipes though the debris barrier in the running sub 215. The production stinger 175 also functions as the mechanical device that opens the FPV 100 as described below. Note that the production stinger 175 does not engage the running sub 215. The production stinger 175 furthermore provides the flow conduit for production, keeping debris out of the inner working of the FPV 100.

Figure 5C:
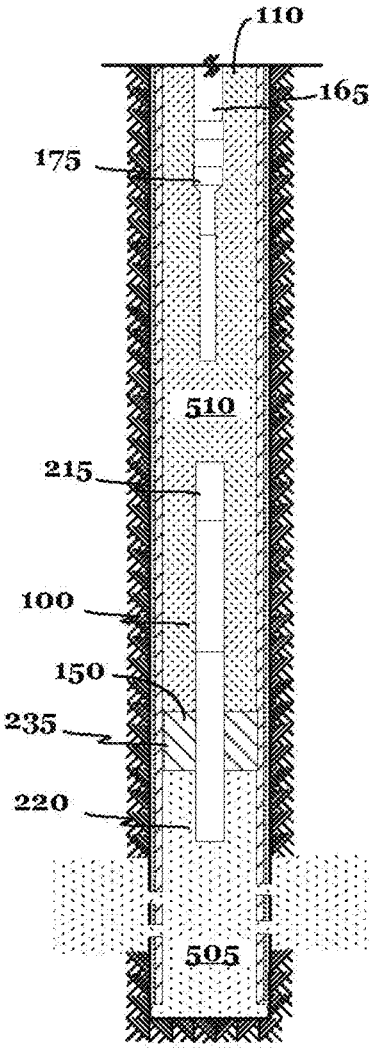

FIG. 5A-FIG. 5C conceptually illustrate running in and out the production string 165 while the FPV 100 is emplaced. Turning now to FIG. 5A, which illustrates running in the production string 165, the well is killed at this point and the wellbore is filled with kill fluids 500. Recall that the FPV 100 is emplaced and closed and that the sealing mechanism 150 is in place. In this particular embodiment, that means the packer 220 is set and the rubber sealing elements 235 are extended and secured against the inner diameter of the casing 135. Thus, the formation fluids 505 in the fluid column 120 are isolated from the kill fluids 510 by the scaling mechanism 150 and the closure of the FPV 100.

The production string 165 is run into the well bore 110 until the production stinger 175 seats on the running sub 215 as shown in FIG. 5B. The manner in which the seating occurs will be implementation specific. In the illustrated embodiment, the production stinger 165 threadably engages the running sub 215 by virtue of the mating threads 425, 430, both shown in FIG. 4. Also as shown in FIG. 4, the inner diameter 435 of the running sub 215 is contoured to conform to the outer diameter 440 of the production stinger 175. The engagement is created by rotating the production stinger 175 from the surface as it is stroked downward until the production stinger 175 is fully seated.

The down stroke of the tongue 405 of the production stinger 175 as the production stinger 175 is seated on the running sub 215 opens the FPV 100. More particularly, as it proceeds downward, the tongue 405 opens the uphole valve 250 and then the downhole valve 260. When the FPV 100 is open and the production stinger 175 is sealably seated on the running sub 215, a sealed fluid flow path is then opened to the surface for the formation fluids 505 to rise and be delivered. Note that the kill fluids 510 in the wellbore 110, if any, are still isolated from the formation fluids 505 by operation of the sealing elements 235. Production then proceeds in accord with conventional practice as shown in FIG. 5B.

There will eventually be a need to trip the ESP 170 or some other portion of the production string 165 out of the wellbore 110. This may be for replacement or repair of the ESP 170, or for some other part of the production string 165, or even retrieval of the FPV 100. The reason is not material for present purposes.

At this point, the production string 165 is installed as shown in FIG. 5B. The well is killed such that kill fluids 510 are introduced into the wellbore 110 if not already present. The production stinger 175 is then disengaged from the running sub 215. This will typically be the inverse of the engagement and, so, will also be implementation specific. In the illustrated embodiment, the running sub 215 is an on/off tool with a threaded engagement, and so the disengagement comprises rotating the production string 165 from the surface to break the threaded connection. In alternative embodiments using, for example, an anchor latch sub, disengagement may be by shearing the latches in accordance with conventional practice.

Note that, as discussed above, the kill fluids 515 and the formation fluids 505 are isolated from one another in FIG. 5B. This isolation is maintained as the production string 165 is disengaged from the running sub 215 by the seals 400 on the tongue 405 on the interior diameter of the FPV 100 and the running sub 215. As the production stinger 175 strokes upward and out of the FPV 100, the downhole valve 260 closes to seal off the formation fluids from entering the FPV 100. As the production stinger 175 continues stroking upward, the uphole valve 250 closes to prevent the kill fluids 515 from entering the FPV 100.

Thus, the FPV seals in both directions—i.e., it is bidirectional—as the production string 165 is retrieved. By the time the seal effected by the seals 400 breaks, one or both of the uphole valve 250 and the downhole valve 260 are closed in order to maintain the isolation between the kill fluids 515 and the formation fluids 505. The entire production string 165 is then retrieved while leaving the FPV 100 emplaced as is shown in FIG. 5C.

Figure 6:
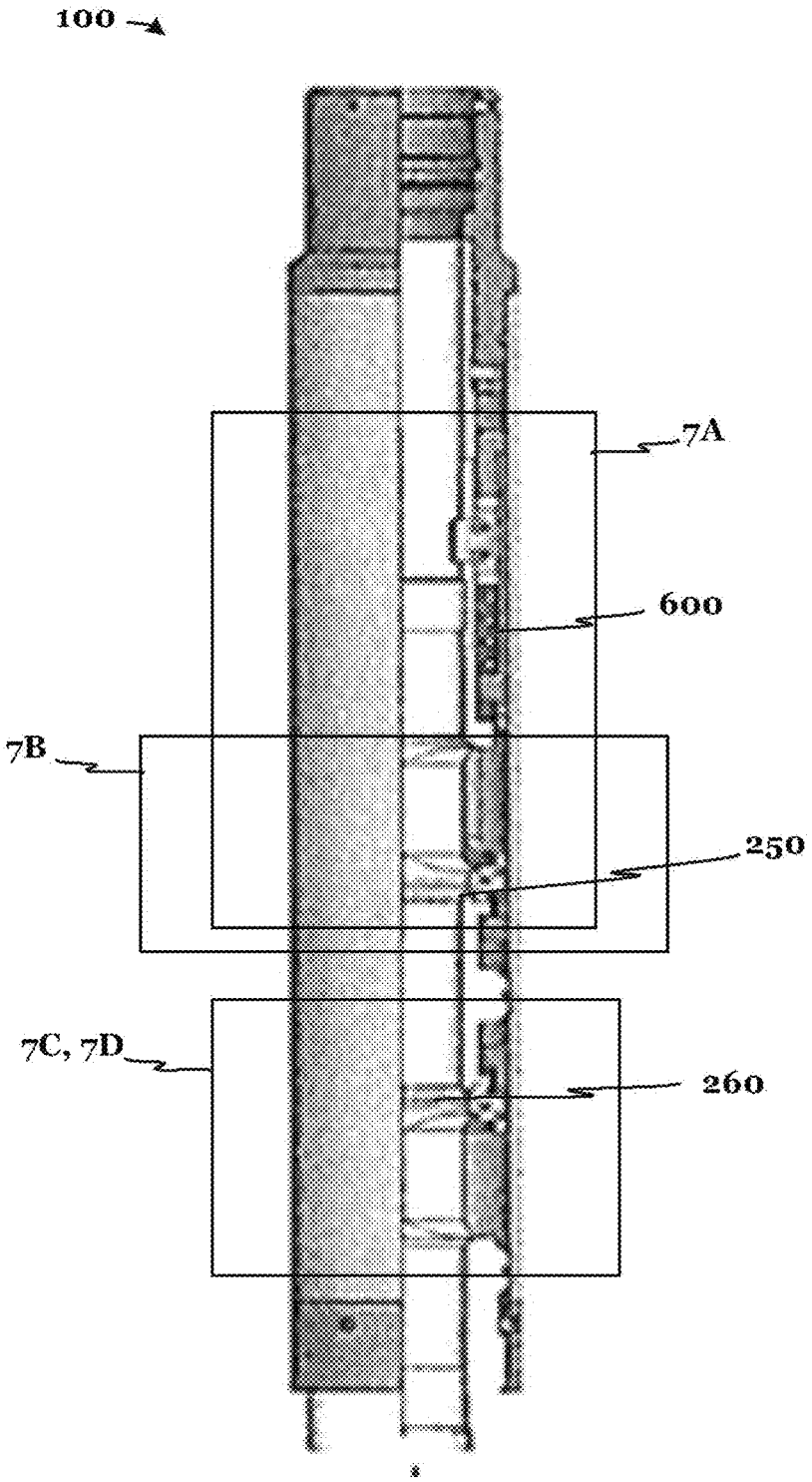
FIG. 6 depicts the formation protection valve in greater detail in a partially sectioned, plan view.

The interaction of the production stinger 175 and the FPV 100 in opening and closing the uphole valve 250 and downhole valve 260 shall now be discussed in greater detail. FIG. 6 depicts the FPV 100 in greater detail in a partially sectioned, plan view. FIG. 7A-FIG. 7D are details of FIG. 6 as indicated therein. FIG. 7A-FIG. 7D depict the FPV 100 of FIG. 6 in greater detail as it is opened by the down stroke of the stingers while running in the production string.

Figure 8A:
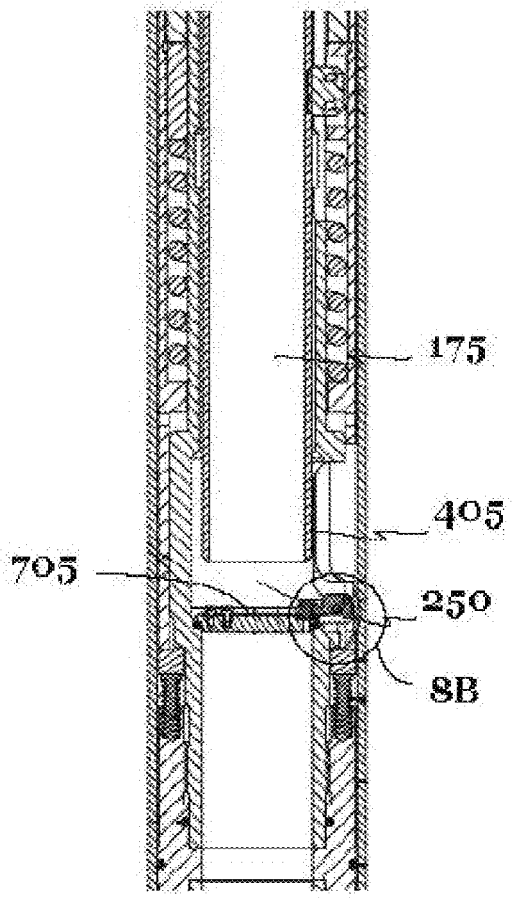
FIG. 8A-FIG. 8B illustrate the top bleeder valve.
Figure 8B:
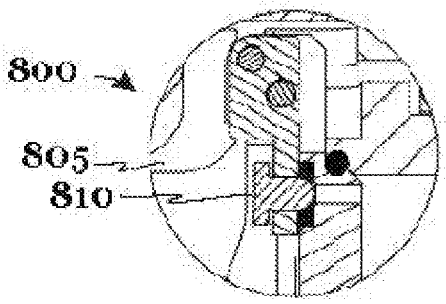

As shown in FIG. 6, prior to engagement with the stinger 175, the uphole valve 250 and the downhole valve 260 are both closed. The uphole valve 250 is biased closed by the operation of the spring 600. As the tongue 405 of the production stinger 175 engages the trip dogs 700, shown in FIG. 7A, a bleeder valve 800, shown in FIG. 8A-FIG. 8B, opens to equalize pressure across the upper closure member 705 of the uphole valve 250. Referring now to FIG. 8A-FIG. 8B, the bleeder valve 800 opens with a running arm 805 activated when the stinger 175 enters the bore (ID) of the FPV body, sliding the spring loaded dogs 700 down the ID, creating force to pivot first the bleeder arm 805 to compress the pin 810 and bleed off pressure, then the flapper lid 705.

Figure 7A:
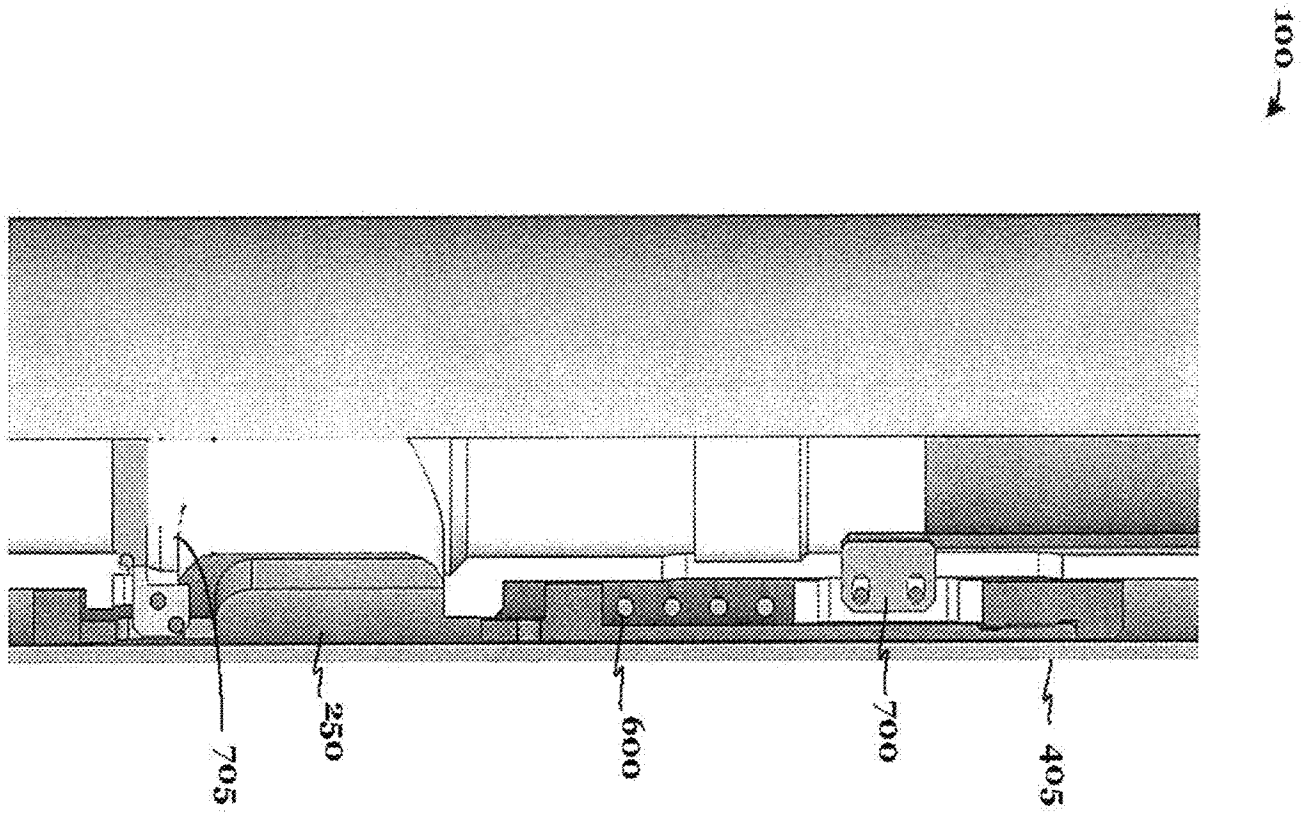
FIG. 7A-FIG. 7D depict the formation protection valve of FIG. 6 in greater detail as it is opened by the down stroke of the stingers while running in the production string.
Figure 7B:
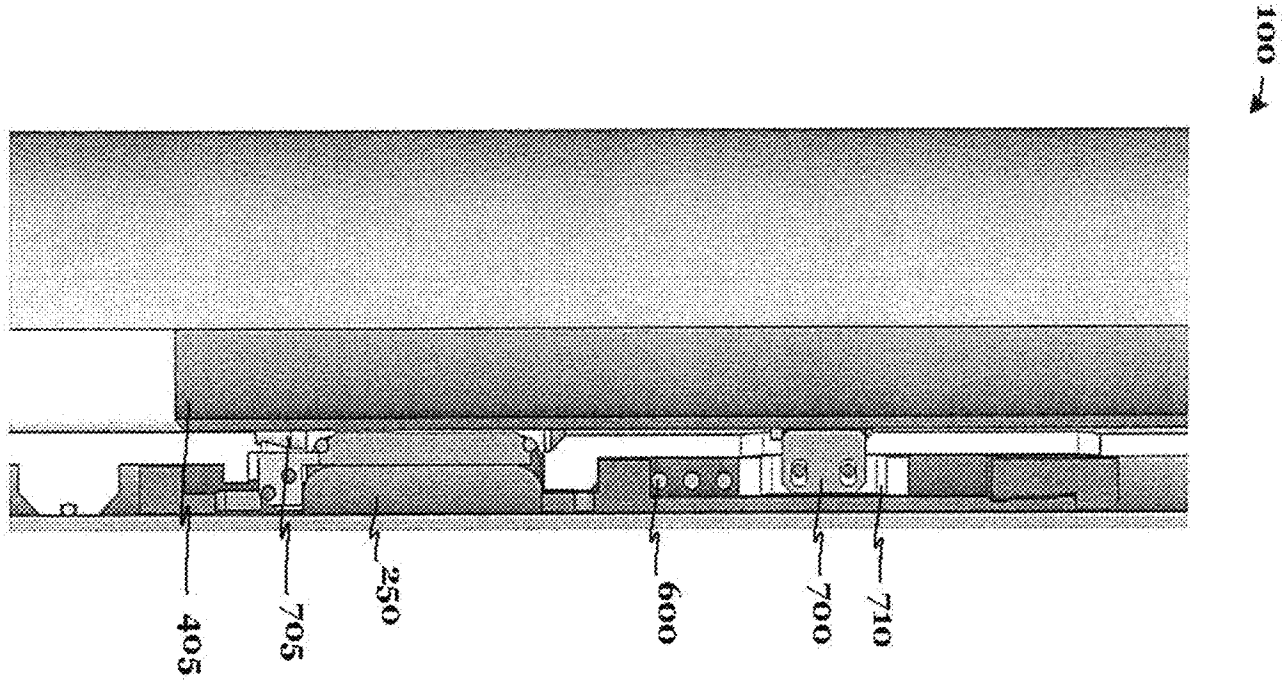

Returning to FIG. 7A, as the production stinger 175 continues to stroke downward and engage the trip dogs 700, the weight of the production string 165 settles on them. This compresses the spring 600, and forces the trip dogs 700 downward while opening the upper closure member 705 as shown in FIG. 7B. As the trip dogs 700 journey downward they reach a profile 710, whereupon they are forced outward by the weight of the production string 165 through the production stinger 175. Once the trip dogs 700 are in the outward position, the production stinger 175 strokes downward and through the upper closure member 705.

Figure 7C:
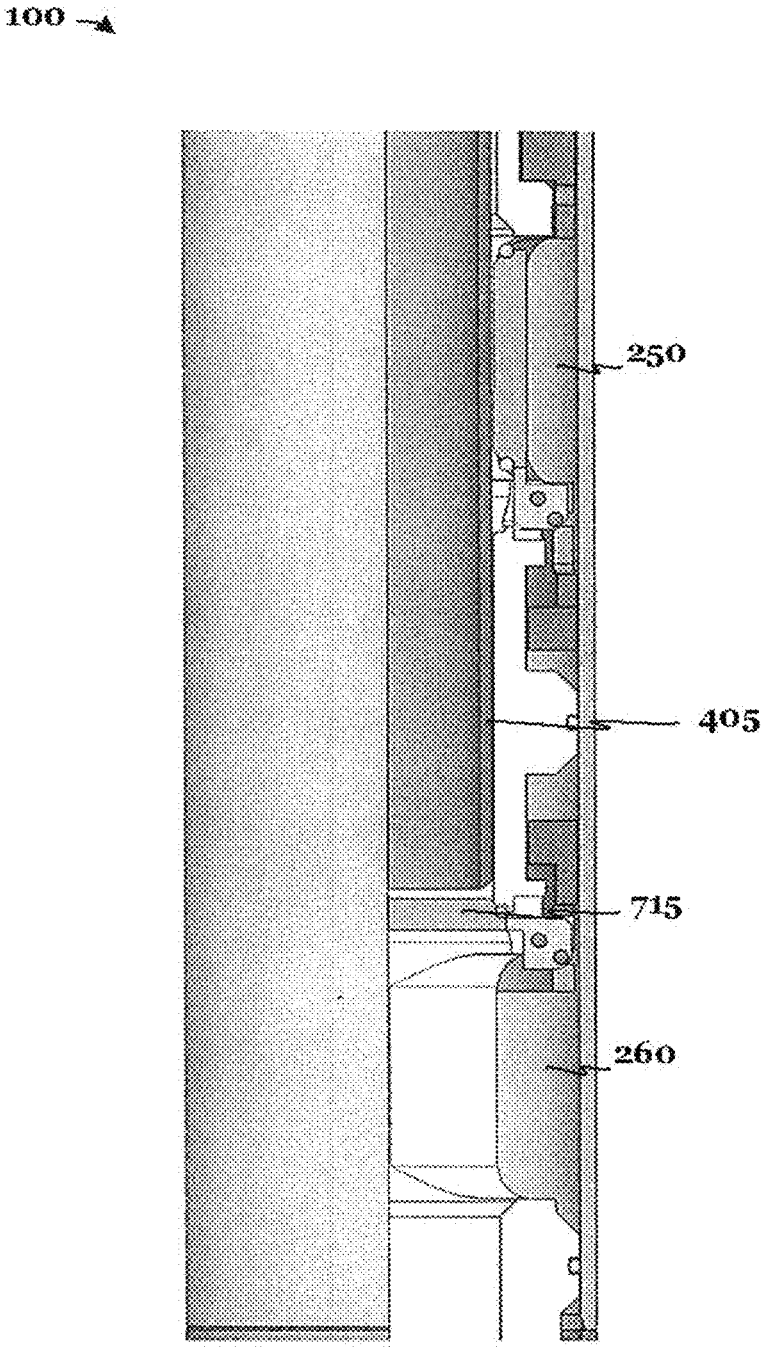
Figure 7D:
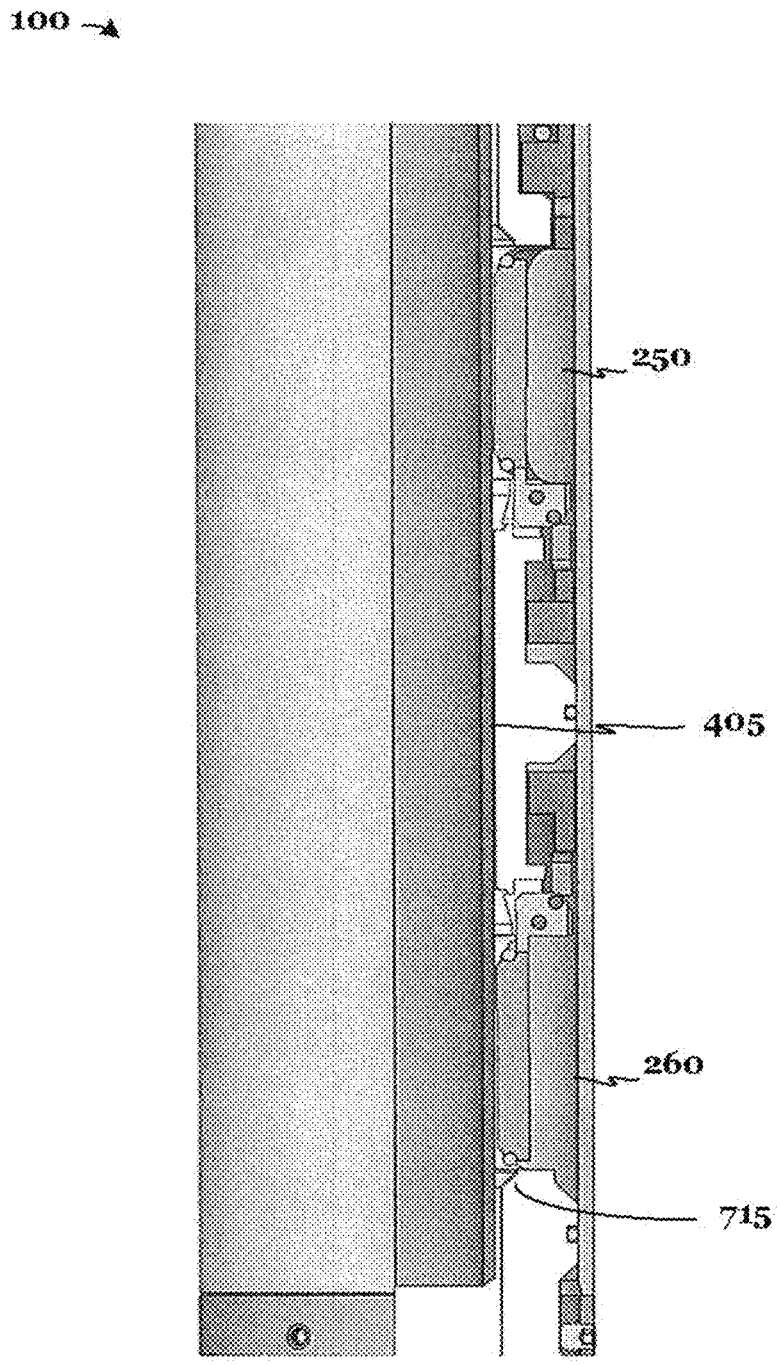
Figure 9B:
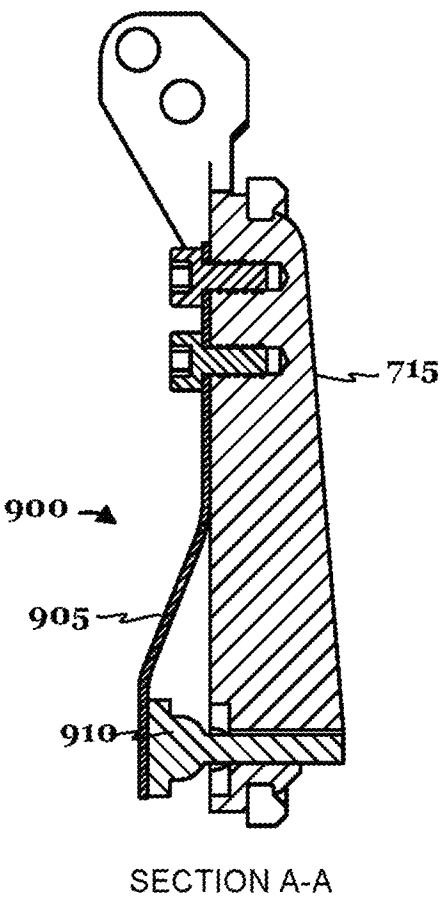
FIG. 9A-FIG. 9C illustrate the bottom bleeder valve.
Figure 9C:
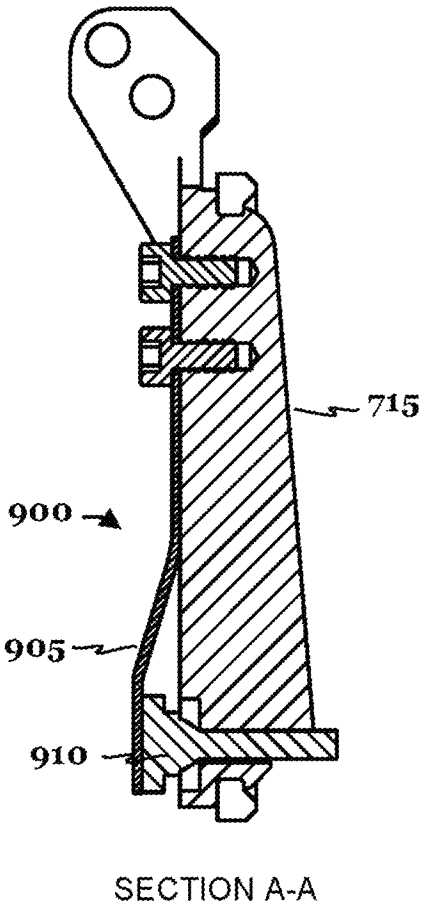
Figure 9A:
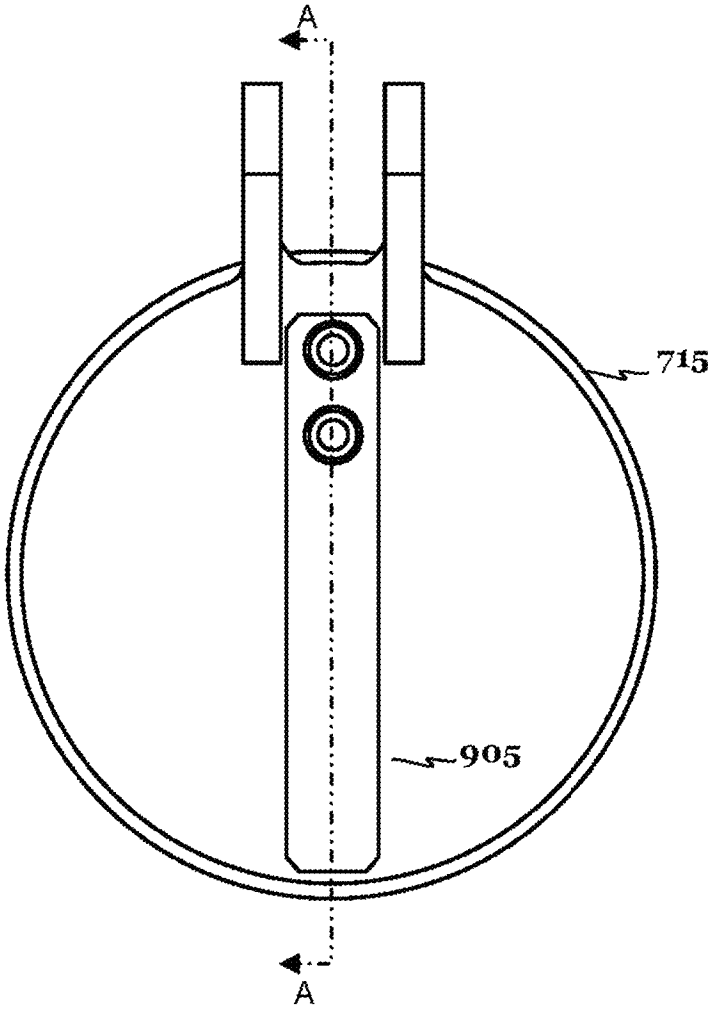

Turning now to FIG. 7C, as the production stinger 175 continues its stroke downward, a bleeder valve 900, shown in FIG. 9A-FIG. 9C, opens to equalize pressure across the lower closure member 715 of the downhole valve 260. The bleeder valve 900 comprises a flat spring 905 and a pin 910, the flat spring 905 as first shown in FIG. 9B. As the production stringer 175 strokes downward, it compresses the spring 905 to force the pin 910 downwardly as shown in FIG. 9C to equalize the pressure on both sides of the lower closure member 715. The production stinger 175 then continues to stroke downward until it engages the closure member 715 of the downhole valve 260. The weight of the production string 165 causes the closure member 715 to open and permit the production stinger 175 to further its downward stroke.

As the production stinger 175 strokes through the downhole valve 260, the FPV 100 is open and in position for production of the formation fluids 505, shown in FIG. 5C, as shown in FIG. 71). Note that, because the running sub 225 remains installed with the emplaced FPV 100, retrieval of the running sub 225. FPV 100, and the packer 220 can be readily performed. Retrieval is essentially that same as emplacement, described above, except that it is performed in reverse.

Thus, in accordance with one aspect of the presently disclosed technique, a method for use in producing hydrocarbons from a well comprises receiving a stinger 175 disposed below an ESP 170 into a closed bidirectional FPV 100 emplaced in a wellbore 110 in a manner isolating wellbore fluids 500 from formation fluids 505. An uphole valve 250 disposed within the inner diameter 242 of the tubular body 240 is opened to control fluid flow therethrough through engagement with the stinger 175 as the stinger 175 is received. A downhole valve 260 is also disposed within the inner diameter 242 of the tubular body 240 downhole of the uphole valve 250 and is opened to control fluid flow therethrough through engagement with the stinger 175 as the stinger 175 is received. The engagement of the stinger 175 with the uphole end of the bidirectional FPV 100 is sealed. Subsequently, the opened downhole valve 260 is closed as the stinger 175 is retrieved followed by the opened uphole valve 250 closing as the stinger 175 is retrieved.

Some of the terms used herein are relative terms. For example, the terms "uphole" and "downhole" are relative to the surface and the bottom of the wellbore. All such relative terms are to be construed in the context of the structures and operations described herein relative the orientation of the bidirectional formation protection valve in its orientation in the wellbore in its intended use.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for use in producing hydrocarbons from a well, comprising:

receiving a stinger disposed below an electronic submersible pump into a closed bidirectional formation protection valve emplaced in a wellbore in a manner isolating wellbore fluids from formation fluids;

opening an uphole valve disposed within the inner diameter of a tubular body to control fluid flow therethrough through engagement with the stinger as the stinger is received, including:

balancing pressure across the uphole valve; and engaging the stinger with a closure member of the uphole valve;

opening a downhole valve disposed within the inner diameter of the tubular body downhole of the uphole valve to control fluid flow therethrough through engagement with the stinger as the stinger is received;

sealing an engagement of the stinger with the uphole end of the bidirectional formation protection valve;

closing the opened downhole valve as the stinger is retrieved; and closing the opened uphole valve as the stinger is retrieved.

2. The method of claim 1, wherein opening the uphole valve further includes:

engaging a set of trip dogs disposed radially about the inner diameter with the stinger;

compressing a spring through the engagement of the stinger with the trip dogs;

forcing the set of trip dogs downward and outward as the spring compresses; and once the trip dogs are positioned outwardly, stroking the stinger through the closure member.

3. The method of claim 2, wherein closing the uphole valve includes:

releasing the compression on the spring, thereby allowing the trip dogs to contract inward and translate upwardly as the stinger runs upward; and contracting the trip dogs into the inner diameter after moving upwardly as the stinger continues to run upward.

4. The method of claim 1, wherein balancing pressure across the uphole valve includes engaging a running arm with the stinger to translate the running arm and open a bleeder valve.

5. The method of claim 1, wherein opening the downhole valve includes:

balancing pressure across the downhole valve; and engaging the stinger with a closure member of the downhole valve.

6. The method of claim 1, wherein:

the uphole valve provides a first barrier between the wellbore fluids and the formation fluids; and the downhole valve provides a second barrier between the wellbore fluids and the formation fluids.

7. The method of claim 1, closing the opened uphole valve as the stinger is retrieved includes:

releasing a plurality of trip dogs to contract and translate upwardly as the stinger runs upward; and contracting the trip dogs into the inner diameter after moving upwardly as the stinger continues to trip upward.

* * * * *